US011798723B2

(12) United States Patent
Sasajima et al.

(10) Patent No.: US 11,798,723 B2
(45) **Date of Patent: *Oct. 24, 2023**

(54) MULTILAYER METAL FILM AND INDUCTOR COMPONENT

(71) Applicant: Murata Manufacturing Co., Ltd., Kyoto-fu (JP)

(72) Inventors: Namiko Sasajima, Nagaokakyo (JP); Hiroki Imaeda, Nagaokakyo (JP); Masami Okado, Nagaokakyo (JP); Shinji Otani, Nagaokakyo (JP); Tomohiro Sunaga, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 526 days.

This patent is subject to a terminal disclaimer.

(21) Appl. No.: 16/830,178

(22) Filed: Mar. 25, 2020

(65) Prior Publication Data

US 2020/0312520 A1 Oct. 1, 2020

(30) Foreign Application Priority Data

Mar. 27, 2019 (JP) ..... 2019-061019

(51) Int. Cl.
*H01F 27/29* (2006.01)
*H01F 27/06* (2006.01)
(Continued)

(52) U.S. Cl.
CPC ..... *H01F 27/06* (2013.01); *H01F 27/255* (2013.01); *H01F 27/29* (2013.01); *H01F 41/04* (2013.01)

(58) Field of Classification Search
CPC ..... H01F 27/06; H01F 27/255; H01F 27/29; H01F 41/04; H01F 19/04;
(Continued)

(56) References Cited

U.S. PATENT DOCUMENTS 6,292,139 B1 * 9/2001 Yamamoto ..... H01Q 1/38 430/315
2015/0053472 A1 * 2/2015 Lee ..... H01G 4/232 361/301.4
(Continued)

FOREIGN PATENT DOCUMENTS

JP 2013-067837 A 4/2013
JP 2014-013815 A 1/2014
(Continued)

OTHER PUBLICATIONS

Office Action; "Notice of Reasons for Refusal," mailed by the Japanese Patent Office dated Oct. 19, 2021, which corresponds to Japanese Patent Application No. 2019-061019 and is related to U.S. Appl. No. 16/830,178 with English translation.

*Primary Examiner* — Mang Tin Bik Lian
(74) *Attorney, Agent, or Firm* — Studebaker & Brackett PC

(57) ABSTRACT

A multilayer metal film disposed on a base having insulating properties includes a first metal film that is in contact with the base and that is electrically conductive, a second metal film covering the first metal film from a side of the first metal film opposite to the base, the second metal film having resistance to solder leaching, and a catalytic layer disposed between the first metal film and the second metal film, the catalytic layer having a protruding portion protruding toward the second metal film, the protruding portion extending into the second metal film.

20 Claims, 6 Drawing Sheets

(51) Int. Cl.
*H01F 41/04* (2006.01)
*H01F 27/255* (2006.01)

(58) Field of Classification Search
CPC ..... H01F 2017/0066; H01F 17/0006; H01F 27/2804; H01F 27/022; H01F 2027/2809; H01F 27/292
See application file for complete search history.

(56) References Cited

U.S. PATENT DOCUMENTS

| | | | | |
|---|---|---|---|---|
| 2016/0225517 | A1* | 8/2016 | Choi | H01F 27/292 |
| 2016/0268038 | A1* | 9/2016 | Choi | H01F 27/255 |
| 2017/0309402 | A1* | 10/2017 | Yamashita | H01F 27/292 |
| 2018/0033552 | A1* | 2/2018 | Lee | H01G 4/30 |
| 2018/0033556 | A1* | 2/2018 | Itamochi | H01L 41/0477 |
| 2018/0082787 | A1* | 3/2018 | Hamamori | H01G 4/2325 |
| 2018/0337001 | A1* | 11/2018 | Tozawa | H01F 17/0013 |
| 2019/0304666 | A1* | 10/2019 | Arai | H05K 1/111 |
| 2020/0312519 | A1* | 10/2020 | Sasajima | H01F 27/06 |

FOREIGN PATENT DOCUMENTS

| | | | |
|---|---|---|---|
| JP | 2015-137418 | A | 7/2015 |
| JP | 2015-232171 | A | 12/2015 |

* cited by examiner

MULTILAYER METAL FILM AND INDUCTOR COMPONENT

CROSS-REFERENCE TO RELATED APPLICATION

This application claims benefit of priority to Japanese Patent Application No. 2019-061019, filed Mar. 27, 2019, the entire content of which is incorporated herein by reference.

BACKGROUND

Technical Field

The present disclosure relates to a multilayer metal film and an inductor component.

Background Art

Hitherto, in electronic components such as inductor components, multilayer metal films formed of stacked metal films have been used for internal electrodes included in electric elements and external terminals used as terminals of electric elements. For example, Japanese Unexamined Patent Application Publication No. 2014-13815 discloses an inductor component including a substrate, a substantially spiral line disposed on each surface of the substrate, a magnetic layer covering the substantially spiral line, an external terminal disposed on a surface of the magnetic layer, and an extended line electrically connecting the substantially spiral line to the external terminal. The substantially spiral line is formed of a multilayer metal film consisting of an underlying Cu layer formed by an electroless plating process on the substrate and two Cu layers formed by performing electrolytic plating twice on the underlying layer. The external terminal is formed by performing sputtering or screen printing before singulation and then plating treatment after the singulation.

In multilayer metal films, main surfaces of stacked metal films are in close contact with each other by a chemical or physical bonding force. Electronic components are subjected to thermal, electrical, and physical forces during production, mounting, and use. These forces can be accumulated in electronic components as internal stress to cause delamination between stacked metal films of multilayer metal films. With a further reduction in the size of electronic components in the future, reductions in the size and thickness of multilayer metal films can cause the delamination even under production, mounting, and use conditions that had no problems in the past.

SUMMARY

Accordingly, the present disclosure provides a multilayer metal film having improved adhesion between metal films and an inductor component including the multilayer metal film.

According to preferred embodiments of the present disclosure, a multilayer metal film disposed on a base having insulating properties includes a first metal film in contact with the base, the first metal film being electrically conductive, a second metal film covering the first metal film from a side of the first metal film opposite to the base, the second metal film having resistance to solder leaching, and a catalytic layer disposed between the first metal film and the second metal film. The catalytic layer has a protruding portion protruding toward the second metal film, and the protruding portion extends into the second metal film.

In this case, the catalytic layer includes the protruding portion that protrudes toward the second metal film and that extends into the second metal film. Thus, the adhesion between the first metal film and the second metal film is improved by the anchoring effect of the protruding portion. The term "catalytic layer" used here refers to a layer containing a metal that promotes the deposition of the second metal film serving as an upper layer. For example, in the case where the second metal film contains Ni, when a layer containing a material such as Pd that promotes the oxidation of a reducing agent in a plating solution during Ni plating is disposed between the first metal film and the second metal film, the deposition of the second metal film can be promoted by electroless plating treatment using the layer containing the material such as Pd as a catalyst. Thus, the layer functions as a catalytic layer.

According to preferred embodiments of the present disclosure, the height of the protruding portion of the catalytic layer may be about two or more times the film thickness of a portion of the catalytic layer other than the protruding portion.

In this case, the adhesion between the first metal film and the second metal film is further improved. When internal stress is accumulated in the second metal film, the protruding portion is easily cracked prior to the second metal film, thus enabling a reduction in the internal stress of the second metal film.

According to preferred embodiments of the present disclosure, a portion of the catalytic layer other than the protruding portion may have a film thickness of about 10 nm or more and about 30 nm or less (i.e., from about 10 nm to about 30 nm).

In this case, the second metal film can be satisfactorily formed, and it is possible to reduce the influence of the catalytic layer on the electrical, physical, and chemical characteristics of the multilayer metal film.

According to preferred embodiments of the present disclosure, the height of the protruding portion of the catalytic layer may be about ½ or less of the film thickness of the second metal film.

In this case, the second metal film can have sufficient resistance to solder leaching.

According to preferred embodiments of the present disclosure, the catalytic layer may contain a metal nobler than the first metal film.

In this case, the catalytic layer can be easily formed by a substitution reaction with the first metal film.

According to preferred embodiments of the present disclosure, the base may include a magnetic resin layer containing a resin and a magnetic metal powder contained in the resin, and the first metal film may be in contact with the magnetic resin layer.

In this case, the first metal film can be deposited using the conductivity of and a substitution reaction with the magnetic metal powder. Additionally, the first metal film can be strongly bonded to the magnetic metal powder to improve the adhesion between the base and the first metal film.

According to preferred embodiments of the present disclosure, the multilayer metal film may further include a third metal film on the second metal film, the third metal film having wettability.

In this case, the wettability of the multilayer metal film can be improved.

According to preferred embodiments of the present disclosure, the first metal film may contain Cu.

In this case, the conductivity of the multilayer metal film can be ensured at low cost. Additionally, the hardness of the first metal film can be lowered, thus reducing internal stress in the multilayer metal film.

According to preferred embodiments of the present disclosure, the second metal film may contain Ni.

In this case, resistance to solder leaching of the multilayer metal film can be easily improved.

According to preferred embodiments of the present disclosure, the catalytic layer may contain Pd.

In this case, the catalytic layer can be easily disposed.

According to preferred embodiments of the present disclosure, an inductor component may include a base, the above-described multilayer metal film, and an inductor device disposed in the base, the multilayer metal film serving as an external terminal exposed at the base, the external terminal being electrically coupled to the inductor device.

In this case, it is possible to provide an inductor component in which delamination in the external terminal is reduced.

Other features, elements, characteristics and advantages of the present disclosure will become more apparent from the following detailed description of preferred embodiments of the present disclosure with reference to the attached drawings.

DETAILED DESCRIPTION

An inductor component according to an aspect of the present disclosure will be described in detail below by an embodiment illustrated. The drawings include some schematic ones and do not always reflect actual dimensions or proportions.

First Embodiment

Configuration

Figure 1A:
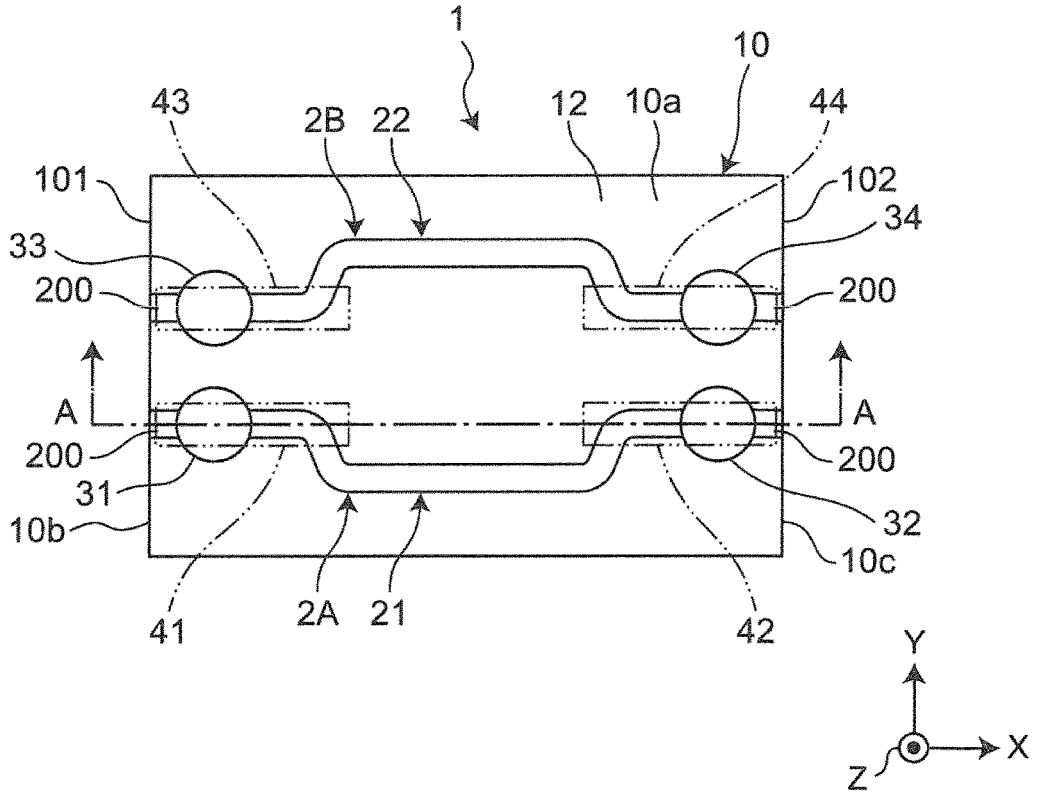
FIG. 1A is a perspective plan view of an inductor component according to a first embodiment.
Figure 1B:
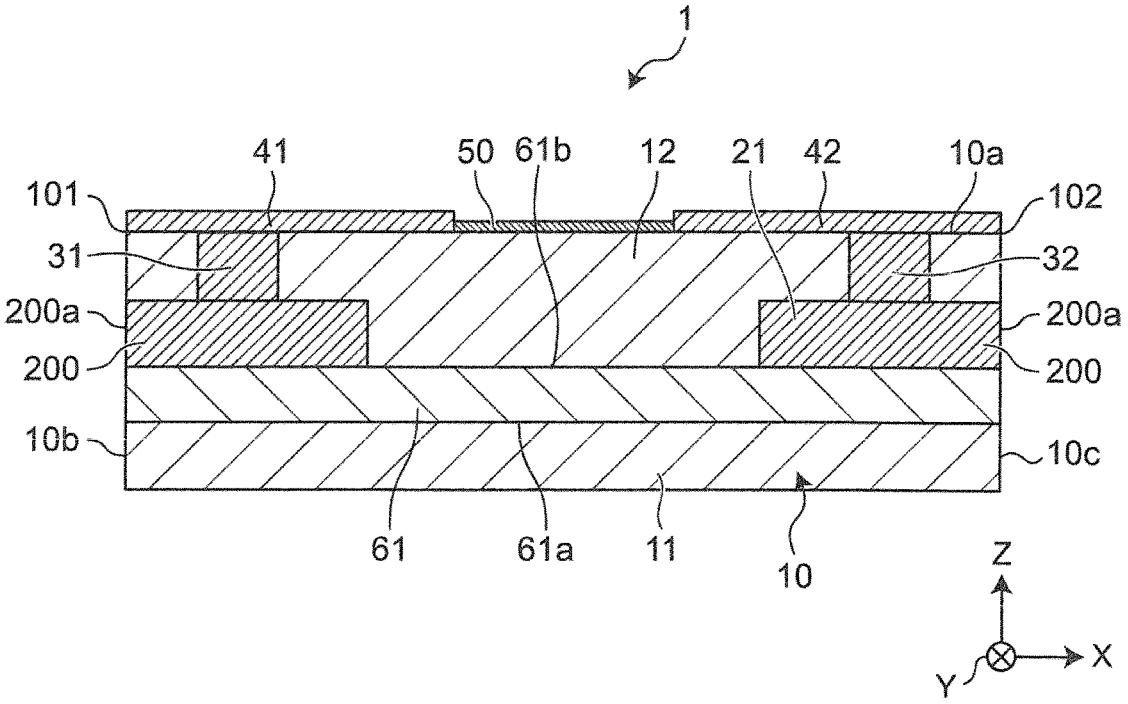
FIG. 1B is a cross-sectional view taken along line A-A of FIG. 1A.
Figure 2:
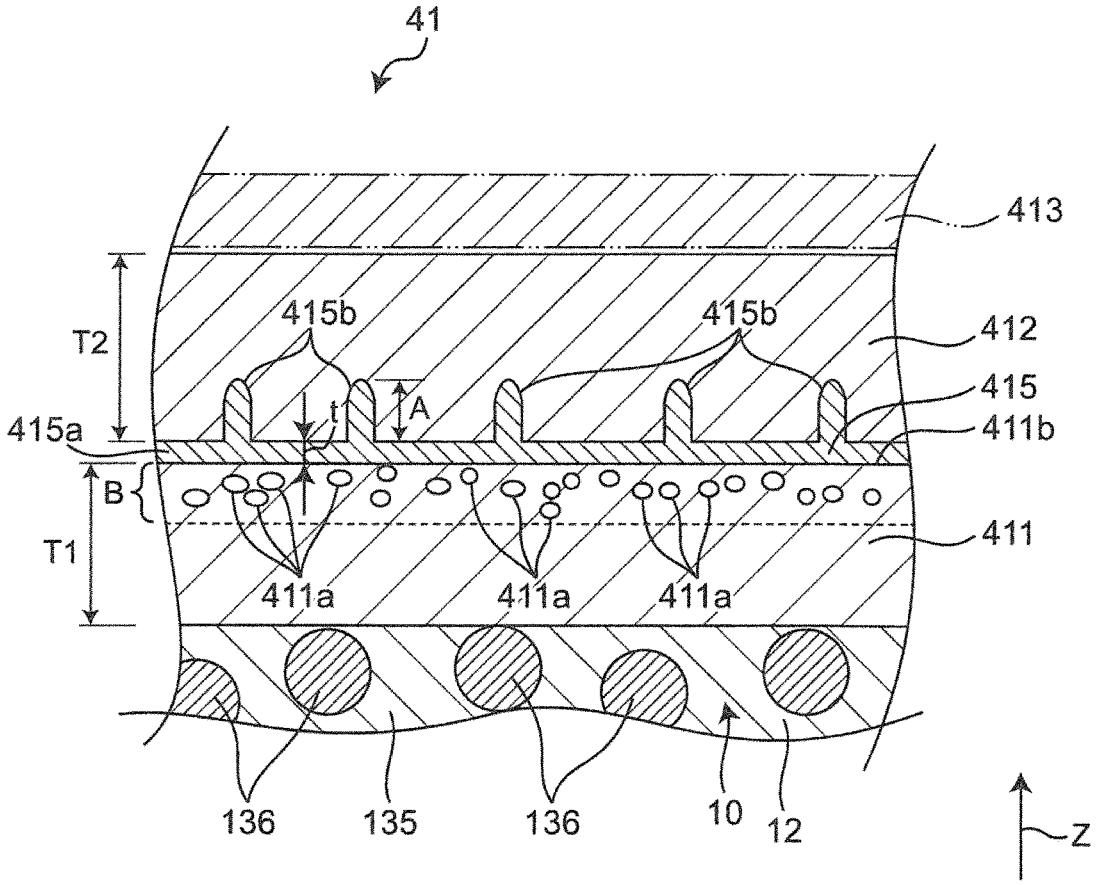
FIG. 2 is a partially enlarged view of FIG. 1B.

FIG. 1A is a perspective plan view of an inductor component according to a first embodiment. FIG. 1B is a cross-sectional view taken along line A-A of FIG. 1A. FIG. 2 is a partially enlarged view of FIG. 1B.

An inductor component 1 is, for example, a surface-mount electronic component mounted on a circuit board installed in an electronic device such as a personal computer, a digital versatile disc (DVD) player, a digital camera, a television (TV) set, a cellular phone, or an automotive electronic system. The inductor component 1, however, may be an electronic component built in a substrate instead of a surface-mount electronic component. The inductor component 1 is, for example, a substantially rectangular parallelepiped component as a whole. The shape of the inductor component 1 may be, but is not particularly limited to, a substantially cylindrical shape, a substantially polygonal columnar shape, a substantially truncated cone shape, or a substantially truncated polygonal pyramid shape.

As illustrated in FIGS. 1A and 1B, the inductor component 1 includes a base 10 having insulating properties, a first inductor device 2A and a second inductor device 2B disposed in the base 10, a first substantially columnar line 31, a second substantially columnar line 32, a third substantially columnar line 33, and a fourth substantially columnar line 34 that are buried in the base 10, an end face of each of the first to fourth substantially columnar lines 31 to 34 being exposed at a substantially rectangular first main surface 10*a* of the base 10, a first external terminal 41, a second external terminal 42, a third external terminal 43, and a fourth external terminal 44 that are disposed on the first main surface 10*a* of the base 10, and an insulating film 50 disposed on the first main surface 10*a* of the base 10. In the figure, a direction parallel to the thickness of the inductor component 1 is defined as a Z direction. The positive Z direction is defined as an upward direction. The negative Z direction is defined as a downward direction. In a plane perpendicular to the Z direction, a direction parallel to the direction of the length of the inductor component 1 is defined as an X direction, and a direction parallel to the direction of the width of the inductor component 1 is defined as a Y direction.

The base 10 includes an insulating layer 61, a first magnetic layer 11 disposed on the lower surface 61*a* of the insulating layer 61, and a second magnetic layer 12 disposed on the upper surface 61*b* of the insulating layer 61. The first main surface 10*a* of the base 10 corresponds to the upper surface of the second magnetic layer 12. The base 10 has a three-layer structure including the insulating layer 61, the first magnetic layer 11, and the second magnetic layer 12. However, the base 10 may have a single-layer structure consisting only of a magnetic layer, a two-layer structure consisting only of a magnetic layer and an insulating layer, or a four-or-more-layer structure consisting of multiple magnetic layers and an insulating layer.

The insulating layer 61 has insulating properties and is a layer having a substantially rectangular main surface. The insulating layer 61 has a thickness of, for example, about 10 μm or more and about 100 μm or less (i.e., from about 10 μm to about 100 μm). The insulating layer 61 is preferably, for example, an insulating resin layer composed of an epoxy resin or a polyimide resin free of a base material such as glass cloth from the viewpoint of reducing the profile. However, the insulating layer 61 may be a sintered layer composed of a magnetic material such as NiZn- or MnZn-based ferrite or a non-magnetic material such as alumina or glass, or may be a resin substrate layer containing a base material such as a glass-epoxy material. When the insulating layer 61 is a sintered layer, the insulating layer 61 has high strength and good flatness, thus improving the process ability of a stacked material on the insulating layer 61. Additionally, when the insulating layer 61 is a sintered layer, the insulating layer 61 is preferably ground, in particular, is preferably ground from the undersurface on which no material is stacked, from the viewpoint of reducing the profile.

Each of the first magnetic layer 11 and the second magnetic layer 12 has high magnetic permeability, is a layer having a substantially rectangular main surface, and contains a resin 135 and a magnetic metal powder 136 in the resin 135. The resin 135 is composed of an organic insulating material such as an epoxy-based resin, bismaleimide, a liquid crystal polymer, or polyimide. The magnetic metal powder 136 is composed of a magnetic metal material such as an FeSi-based alloy, e.g., FeSiCr, an FeCo-based alloy, an Fe-based alloy, e.g., NiFe, or an amorphous alloy thereof. The magnetic metal powder 136 has an average particle size of, for example, about 0.1 μm or more and about 5 μm or less (i.e., from about 0.1 μm to about 5 μm). In a production process of the inductor component 1, the average particle size of the magnetic metal powder 136 can be calculated as a particle size (what is called "D50") corresponding to a 50% cumulative value in a particle size distribution determined by a laser diffraction/scattering method. The amount of the magnetic metal powder 136 contained is preferably about 20% or more by volume and about 70% or less by volume (i.e., from about 20% by volume to about 70% by volume) based on the entire magnetic layer. When the magnetic metal powder 136 has an average particle size of about 5 μm or less, the direct current superposition characteristics can be further improved. The use of the fine powder can reduce the iron loss at high frequencies. A magnetic powder composed of a NiZn- or MnZn-based ferrite may be used instead of the magnetic metal powder.

The first inductor device 2A and the second inductor device 2B include a first substantially spiral line 21 and a second substantially spiral line 22, respectively, disposed in parallel with the first main surface 10*a* of the base 10. Thereby, the first inductor device 2A and the second inductor device 2B can be configured in a direction parallel to the first main surface 10*a* to achieve the low profile of the inductor component 1. The first substantially spiral line 21 and the second substantially spiral line 22 are disposed on the same plane in the base 10. Specifically, the first substantially spiral line 21 and the second substantially spiral line 22 are disposed only on the upper side of the insulating layer 61, i.e., the upper surface 61*b* of the insulating layer 61, and are covered with the second magnetic layer 12.

Each of the first and second substantially spiral lines 21 and 22 is wound in a plane. Specifically, each of the first and second substantially spiral lines 21 and 22 has a substantially semi-elliptical arc shape when viewed from the Z direction. That is, each of the first and second substantially spiral lines 21 and 22 is a curved line wound about a half turn. Additionally, each of the first and second substantially spiral lines 21 and 22 includes a straight portion in an intermediate section. In the present disclosure, the term "spiral" of each substantially spiral line refers to a substantially curved shape including a substantially spiral shape wound in a plane and includes a substantially curved shape, such as the first substantially spiral line 21 or the second substantially spiral line 22, wound one turn or less. The substantially curved shape may partially include a straight portion.

Each of the first and second substantially spiral lines 21 and 22 preferably has a thickness of, for example, about 40 μm or more and about 120 μm or less (i.e., from about 40 μm to about 120 μm). In some embodiments, each of the first and second substantially spiral lines 21 and 22 has a thickness of about 45 μm, a line width of about 40 μm, and a line spacing of about 10 μm. The line spacing is preferably about 3 μm or more and about 20 μm or less (i.e., from about 3 μm to about 20 μm) from the viewpoint of achieving good insulating properties.

Each of the first and second substantially spiral lines 21 and 22 is composed of a conductive material and, for example, a low-electrical-resistance metal material such as Cu, Ag, or Au. In this embodiment, the inductor component 1 includes only a single layer of the first and second substantially spiral lines 21 and 22. This can achieve the low-profile inductor component 1. Each of the first and second substantially spiral lines 21 and 22 may be formed of a multilayer metal film and, for example, may have a structure in which a conductive layer composed of, for example, Cu or Ag is disposed on an undercoat layer, composed of, for example, Cu or Ti, deposited by electroless plating.

The first substantially spiral line 21 has a first end portion and a second end portion that are electrically coupled to the first substantially columnar line 31 and the second substantially columnar line 32, respectively, located at outer side portions and is curved in an arc from the first substantially columnar line 31 and the second substantially columnar line 32 toward the center of the inductor component 1. The first substantially spiral line 21 has pad portions having a larger line width than the substantially spiral shaped portion at both end portions thereof and is directly connected to the first and second substantially columnar lines 31 and 32 at the pad portions.

Similarly, the second substantially spiral line 22 has a first end portion and a second end portion that are electrically coupled to the third substantially columnar line 33 and the fourth substantially columnar line 34, respectively, located at outer side portions and is curved in an arc from the third substantially columnar line 33 and the fourth substantially columnar line 34 toward the center of the inductor component 1.

Here, in each of the first and second substantially spiral lines 21 and 22, a range surrounded by a curve of the first or second substantially spiral line 21 or 22 and a straight line connecting both end portions of the first or second substantially spiral line 21 or 22 is defined as an inside diameter portion. The inside diameter portions of the first and second substantially spiral lines 21 and 22 do not overlap with each other, and the first and second substantially spiral lines 21 and 22 are separated from each other, when viewed from the Z direction.

Lines extend in a direction parallel to the X direction from connection positions of the first and second substantially spiral lines 21 and 22 and the first to fourth substantially columnar lines 31 and 34 and toward the outside of the inductor component 1. The lines are exposed outside the inductor component 1. That is, the first and second substantially spiral lines 21 and 22 have exposed portions 200 each exposed to the outside at a side surface parallel to the stacking direction of the inductor component 1 (a plane parallel to the YZ plane).

The lines are used to be coupled to a feeding line when additional electroplating is performed after the formation of the shapes of the first and second substantially spiral lines 21 and 22 in the production process of the inductor component 1. The use of the feeding line enables easy implementation of additional electroplating in a state of an inductor substrate before the singulation of the inductor substrate into individual inductor components 1, thereby reducing the distance between the lines. The implementation of the additional electroplating can reduce the distance between the first and second substantially spiral lines 21 and 22, thereby enhancing the magnetic coupling of the first and second substantially spiral lines 21 and 22, increasing the line width of the first and second substantially spiral lines 21 and 22 to reduce the electrical resistance, and reducing the outside shape of the inductor component 1.

The first and second substantially spiral lines 21 and 22 have the exposed portions 200 and thus can be highly resistant to electrostatic discharge damage during the processing of the inductor substrate. In each of the substantially spiral lines 21 and 22, the thickness (a dimension in the Z direction) of the exposed surface 200*a* of each exposed portion 200 is preferably equal to or less than the thickness (a dimension in the Z direction) of the substantially spiral line 21 or 22 and about 45 μm or more. In the case where the thickness of the exposed surface 200*a* is equal to or less than the thickness of the substantially spiral line 21 or 22, the proportions of the magnetic layers 11 and 12 can be increased to improve the inductance. In the case where the thickness of the exposed surface 200*a* is about 45 μm or more, the occurrence of disconnection near the exposed surface 200*a* can be reduced. The exposed surface 200*a* is preferably formed of an oxide film. In this case, a short circuit can be suppressed between the inductor component 1 and its adjacent component.

The first to fourth substantially columnar lines 31 and 34 extend in the Z direction from the substantially spiral lines 21 and 22 and penetrate through the second magnetic layer 12. The first substantially columnar line 31 extends upward from the upper surface of one end portion of the first substantially spiral line 21. An end face of the first substantially columnar line 31 is exposed at the first main surface 10*a* of the base 10. The second substantially columnar line 32 extends upward from the upper surface of the other end portion of the first substantially spiral line 21. An end face of the second substantially columnar line 32 is exposed at the first main surface 10*a* of the base 10. The third substantially columnar line 33 extends upward from the upper surface of one end portion of the second substantially spiral line 22. An end face of the third substantially columnar line 33 is exposed at the first main surface 10*a* of the base 10. The fourth substantially columnar line 34 extends upward from the upper surface of the other end portion of the second substantially spiral line 22. An end face of the fourth substantially columnar line 34 is exposed at the first main surface 10*a* of the base 10.

The first substantially columnar line 31, the second substantially columnar line 32, the third substantially columnar line 33, and the fourth substantially columnar line 34 extend linearly from the first inductor device 2A and the second inductor device 2B to the end faces exposed at the first main surface 10*a* in a direction perpendicular to the end faces. Thereby, the first external terminal 41, the second external terminal 42, the third external terminal 43, and the fourth external terminal 44 can be coupled to the first inductor device 2A and the second inductor device 2B at a shorter distance, thus enabling the inductor component 1 to have lower resistance and higher inductance. The first to fourth substantially columnar lines 31 to 34 are composed of a conductive material and, for example, the same material as that of the first and second substantially spiral lines 21 and 22.

Each of the first to fourth external terminals 41 to 44 is formed of a multilayer metal film disposed on the first main surface 10*a* of the base 10 (the upper surface of the second magnetic layer 12). The first external terminal 41 is in contact with the end face of the first substantially columnar line 31 exposed at the first main surface 10*a* of the base 10 and electrically coupled to the first substantially columnar line 31. Thereby, the first external terminal 41 is electrically coupled to one end portion of the first substantially spiral line 21. The second external terminal 42 is in contact with an end face of the second substantially columnar line 32 exposed at the first main surface 10*a* of the base 10 and electrically coupled to the second substantially columnar line 32. Thereby, the second external terminal 42 is electrically coupled to the other end portion of the first substantially spiral line 21.

Similarly, the third external terminal 43 is in contact with the end face of the third substantially columnar line 33 and electrically coupled to the third substantially columnar line 33, thereby electrically coupled to one end portion of the second substantially spiral line 22. The fourth external terminal 44 is in contact with the end face of the fourth substantially columnar line 34 and electrically coupled to the fourth substantially columnar line 34, thereby electrically coupled to the other end of the second substantially spiral line 22.

The first main surface 10*a* of the inductor component 1 has a first end edge 101 and a second end edge 102 that extend linearly and that correspond to sides of a substantially rectangular shape. The first end edge 101 and the second end edge 102 are end edges of the first main surface 10*a* connected to a first side surface 10*b* and a second side surface 10*c*, respectively, of the base 10. The first external terminal 41 and the third external terminal 43 are arranged along the first end edge 101 adjacent to the first side surface 10*b* of the base 10. The second external terminal 42 and the fourth external terminal 44 are arranged along the second end edge 102 adjacent to the second side surface 10*c* of the base 10. The first side surface 10*b* and the second side surface 10*c* of the base 10 extend in the Y direction and coincide with the first end edge 101 and the second end edge 102, respectively, when viewed from a direction perpendicular to the first main surface 10*a* of the base 10. The arrangement direction of the first external terminal 41 and the third external terminal 43 is a direction connecting the center of the first external terminal 41 and the center of the third external terminal 43. The arrangement direction of the second external terminal 42 and the fourth external terminal 44 is a direction connecting the center of the second external terminal 42 and the center of the fourth external terminal 44.

The insulating film 50 is disposed on a portion of the first main surface 10*a* of the base 10 where the first to fourth external terminals 41 to 44 are not disposed. However, end portions of the first to fourth external terminals 41 to 44 may extend on portions of the insulating film 50, so that the portions of the insulating film 50 may overlap the end portions of the first to fourth external terminals 41 to 44 in the Z direction. The insulating film 50 is composed of, for example, a resin material, such as an acrylic resin, an epoxy-based resin, or polyimide, having high electrical insulating properties. This can improve the insulation among the first to fourth external terminals 41 to 44. The insulating film 50 serves as a mask used for the pattern formation of the first to fourth external terminals 41 to 44 to improve the production efficiency. When the magnetic metal powder 136 is exposed at a surface of the resin 135, the insulating film 50 can cover the exposed magnetic metal powder 136 to prevent the exposure of the magnetic metal powder 136 to the outside. The insulating film 50 may contain a filler composed of an insulating material such as silica or barium sulfate.

As illustrated in FIG. 2, the first external terminal 41 is formed of a multilayer metal film and includes a first metal film 411 in contact with the base 10 (second magnetic layer 12), a second metal film 412 covering the first metal film 411 from a side of the first metal film 411 opposite to the base 10, and a catalytic layer 415 disposed between the first metal film 411 and the second metal film 412. The structures of second, third, and fourth external terminals 42, 43, and 44 are the same as the structure of the first external terminal 41. Thus, only the first external terminal 41 will be described below.

The first metal film 411 is electrically conductive and serves to reduce the electrical resistance of the first external terminal 41. The first metal film 411 is formed by, for example, electroless plating but may be formed by electroplating. In the case where the first metal film 411 is formed by electroless plating, because the base 10 contains the magnetic metal powder 136, the first metal film 411 can be deposited on the magnetic metal powder 136 by a substitution reaction with the magnetic metal powder 136, thereby improving the adhesion between the base 10 and the first metal film 411.

The second metal film 412 has resistance to solder leaching and covers the first metal film 411, thus suppressing the solder leaching of the first metal film 411 of the first external terminal 41 due to mounting solder. The second metal film 412 is formed by, for example, electroless plating with the catalytic layer 415.

The catalytic layer 415 includes a film-like base portion 415*a* and multiple protruding portions 415*b* disposed on the base portion 415*a*. The protruding portions 415*b* protrude into the second metal film 412 and extend to the second metal film 412. Thus, the adhesion between the first metal film 411 and the second metal film 412 is improved by the anchoring effect of the protruding portions 415*b*. Specifically, stress can occur in the first metal film 411 or the second metal film 412 at the time of the production, mounting, or use of the inductor component 1 by the difference in coefficient of linear expansion between the first metal film 411 and the second metal film 412 and the action of an external force on the first external terminal 41. However, the protruding portions 415*b* of the catalytic layer 415 serve as anchors for the second metal film 412, thus improving the adhesion between the first metal film 411 and the second metal film 412. The catalytic layer 415 is formed by, for example, a substitution reaction with the first metal film 411.

The height A of the protruding portions 415*b* of the catalytic layer 415 is preferably about two or more times the film thickness t of a portion (i.e., the base portion 415*a*) of the catalytic layer 415 other than the protruding portions 415*b*. The height A and the film thickness t are dimensions of the protruding portions 415*b* and the base portion 415*a*, respectively, measured in a direction parallel to the Z direction.

In this case, the height A of the protruding portions 415*b* can be increased, and the adhesion between the first metal film 411 and the second metal film 412 is further improved by the anchoring effect of the protruding portions 415*b*. When internal stress is accumulated in the second metal film 412, the protruding portions 415*b* are easily cracked prior to the second metal film 412, thus enabling a reduction in the internal stress of the second metal film 412. Accordingly, the protruding portions 415*b* may have a crack, and the crack can reliably reduce the internal stress of the second metal film 412.

The measurement conditions of the height and the film thickness (including measurements of height and film thickness described below) are as follows: The measurements are performed by observing a scanning electron microscope (SEM) image of a cross section obtained by cutting a measurement object (in the above case, the first external terminal 41) at the center of a surface perpendicular to the measurement dimensions (height and film thickness) of the measurement object. Specifically, a sample such as the inductor component 1 is processed to expose a cross section passing through the center of the multilayer metal film to be measured. An image of the cross section is captured with a SEM at a magnification of 10,000. The measurements are performed on the image. The height A of the protruding portions 415*b* may be obtained by measuring the maximum dimension thereof. The film thickness t of the base portion 415*a* may be obtained by measuring the film thickness at five points excluding the end portions and calculating the average value. The film thicknesses described below are similarly calculated.

A portion (i.e., the base portion 415*a*) of the catalytic layer 415 other than the protruding portions 415*b* preferably has a film thickness t of about 10 nm or more and about 30 nm or less (i.e., from about 10 nm to about 30 nm).

A film thickness t of about 10 nm or more results in satisfactory formation of the second metal film. A film thickness t of about 30 nm or less results in a reduction in the influence of the catalytic layer on the electrical, physical, and chemical characteristics of the first external terminal 41.

The height A of the protruding portions 415*b* of the catalytic layer 415 is preferably about ½ or less of the film thickness T2 of the second metal film 412. In this case, the second metal film 412 can ensure sufficient resistance to solder leaching.

The catalytic layer 415 preferably contains a metal nobler than the first metal film 411. In this case, the catalytic layer 415 can be formed by a substitution reaction with the first metal film 411.

The first metal film 411 includes multiple pore portions 411*a* adjacent to the catalytic layer 415. Adjacent pore portions 411*a* may be separated from each other or connected together. The pore portions 411*a* of the first metal film 411 can reduce internal stress accumulated in the first external terminal 41 (multilayer metal film), for example, in a portion between the first metal film 411 and the second metal film 412. Specifically, internal stress occurs in the first external terminal 41, for example, in a portion between the first metal film 411 and the second metal film 412 at the time of the production, mounting, or use of the inductor component 1 by the difference in coefficient of linear expansion between the first metal film 411 and the second metal film 412 and the action of an external force on the first external terminal 41. However, the accumulated internal stress is released in the pore portions 411*a* of the first metal film 411, thereby reducing the internal stress accumulated in the first external terminal 41.

The pore portions 411*a* of the first metal film 411 are preferably hollow. In this case, a decrease in the purity of the first metal film 411 due to the contamination of the pore portions 411*a* of the first metal film 411 with impurities can be suppressed. The pore portions 411*a* of the first metal film 411 may contain an impurity other than the material of the first metal film 411. For example, a composition (sulfur or the like) other than a plating solution may be contained.

The pore portions 411*a* of the first metal film 411 are preferably present in a range B extending from a first main surface 411*b* of the first metal film 411 adjacent to the catalytic layer 415 to a position about ¼ or less of the film thickness T1 of the first metal film 411. In this case, a region where the pore portions 411*a* of the first metal film 411 are present can be reduced to provide the first metal film 411 having high strength.

Each of the pore portions 411*a* of the first metal film 411 preferably has a size such that delamination does not occur between the first metal film 411 and the second metal film 412. Here, a degree to which delamination does not occur between the first metal film 411 and the second metal film 412 indicates that, for example, when a large pore portion 411*a* is present, or even when the multiple pore portions 411*a* are present and the multiple pore portions 411*a* communicate with each other, the size is a certain level or less, or indicates that a level at which the first metal film 411 and the second metal film 412 are electrically coupled to each other. Specifically, the size of the pore portions 411*a* is preferably about 0.5 μm or less. The electrical resistance between the first metal film 411 and the second metal film 412 is preferably 1 mΩ or less. In these cases, it can be determined that no delamination occurs between the first metal film 411 and the second metal film 412. Thus, the functionality and reliability of the first external terminal 41 (multilayer metal film) including the first metal film 411 and the second metal film 412 can be ensured.

The first metal film 411 preferably has lower hardness than the second metal film 412. The hardness used here refers to, for example, Vickers hardness. In this case, the accumulation of internal stress can be further reduced by the use of the first metal film 411 softer than the second metal film 412.

The first metal film 411 preferably contains Cu. In this case, the conductivity of the first external terminal 41 can be ensured at low cost. Additionally, the hardness of the first metal film 411 can be lowered, thus reducing the accumulation of internal stress in the first external terminal 41 including the first metal film 411. The film thickness of the first metal film 411 is preferably larger than those of other metal films of the first external terminal 41. In this case, the internal stress can be further reduced while the conductivity of the first external terminal 41 is improved. The first metal film 411 may contain at least one of Ag, Au, Al, Ni, Fe, and Pd, other than Cu.

The second metal film 412 preferably contains Ni. In this case, the resistance to solder leaching of the first external terminal 41 can be easily improved. Additionally, this can reduce the electrochemical migration of the first metal film 411. The second metal film 412 may contain at least one of Pd, Pt, Co, and Fe, other than Ni.

The catalytic layer 415 preferably contains Pd. In this case, the catalytic layer 415 can be easily composed of a metal nobler than a metal contained in the first metal film 411. Furthermore, when the second metal film 412 is formed by electroless plating, the oxidation of a reducing agent such as hypophosphorous acid can be easily promoted to further promote the deposition of the second metal film 412. The catalytic layer 415 may contain at least one of Ag, Cu, Pt, and Au, other than Pd.

Preferably, as indicated by imaginary lines in FIG. 2, the first external terminal 41 further includes a third metal film 413 having wettability on the second metal film 412. In this case, the wettability of the first external terminal 41 can be improved. The third metal film 413 contains, for example, at least one of Au, Sn, Pd, and Ag.

Production Method

A method for producing the inductor component 1 will be described below.

Figure 3A:
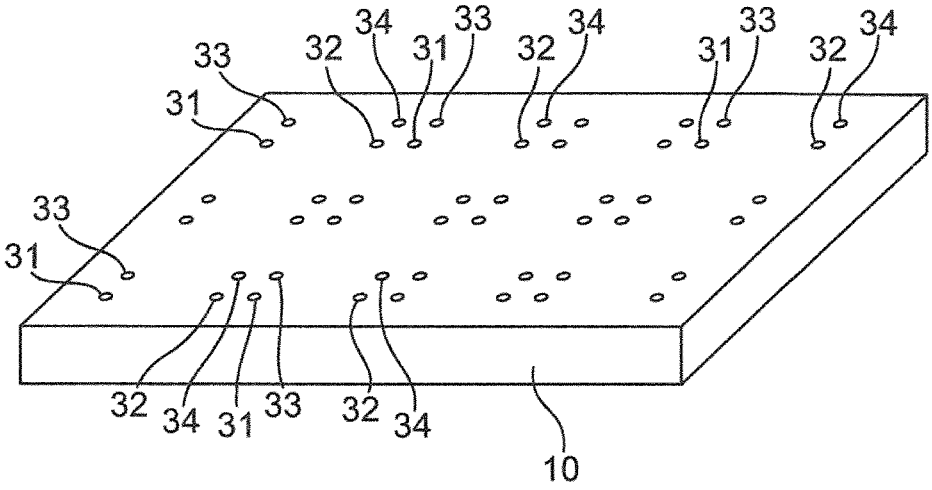
FIG. 3A is an explanatory view of a method for producing an inductor component.
Figure 3B:
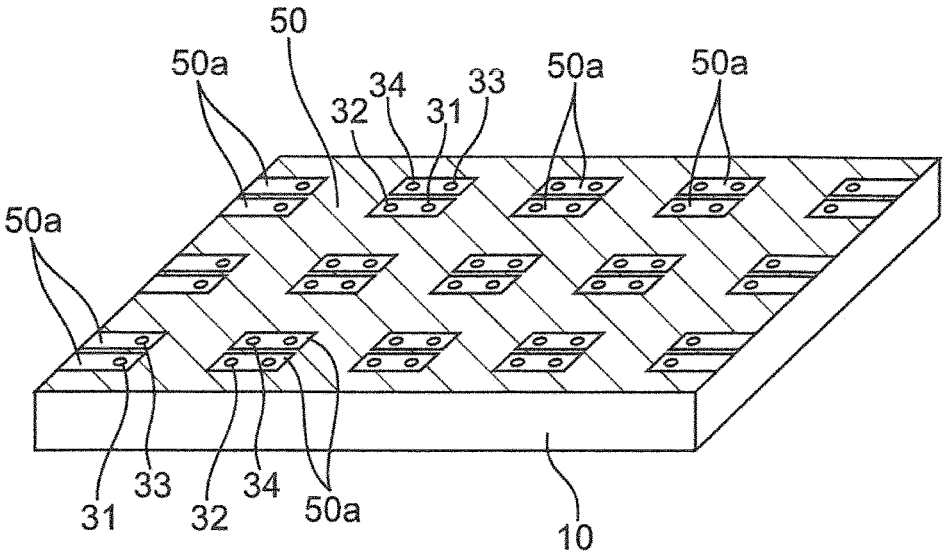
FIG. 3B is an explanatory view of the method for producing an inductor component.

As illustrated in FIG. 3A, the upper surface of the base 10 is subjected to grinding processing such as grinding in a state in which the multiple spiral lines 21 and 22 and the multiple substantially columnar lines 31 to 34 are covered with the base 10. Thereby, the end faces of the substantially columnar lines 31 to 34 are exposed at the upper surface of the base 10. As illustrated in FIG. 3B, the insulating film 50 represented by a hatch pattern is then formed on the entire upper surface of the base 10 by, for example, a coating method such as spin coating or screen printing, or a dry process such as the lamination of a dry film resist. The insulating film 50 is formed of, for example, a photosensitive resist.

Portions of the insulating film 50 are removed by, for example, photolithography, laser processing, drilling, or blasting in regions where external terminals are to be formed, so that through-holes 50*a* at which end faces of the substantially columnar lines 31 to 34 and part of the base 10 (second magnetic layer 12) are exposed are formed in the insulating film 50. At this time, as illustrated in FIG. 3B, an end face of each of the substantially columnar lines 31 to 34 may be entirely or partially exposed at a corresponding one of the through-holes 50*a*. The end faces of the multiple substantially columnar lines 31 to 34 may be exposed at one of the through-holes 50*a*.

Figure 3C:
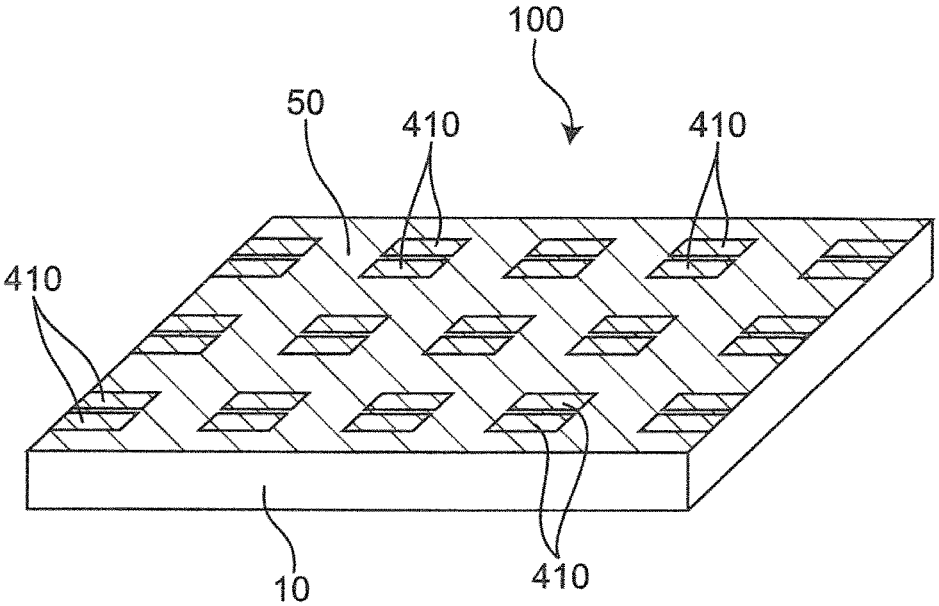
FIG. 3C is an explanatory view of the method for producing an inductor component.
Figure 3D:
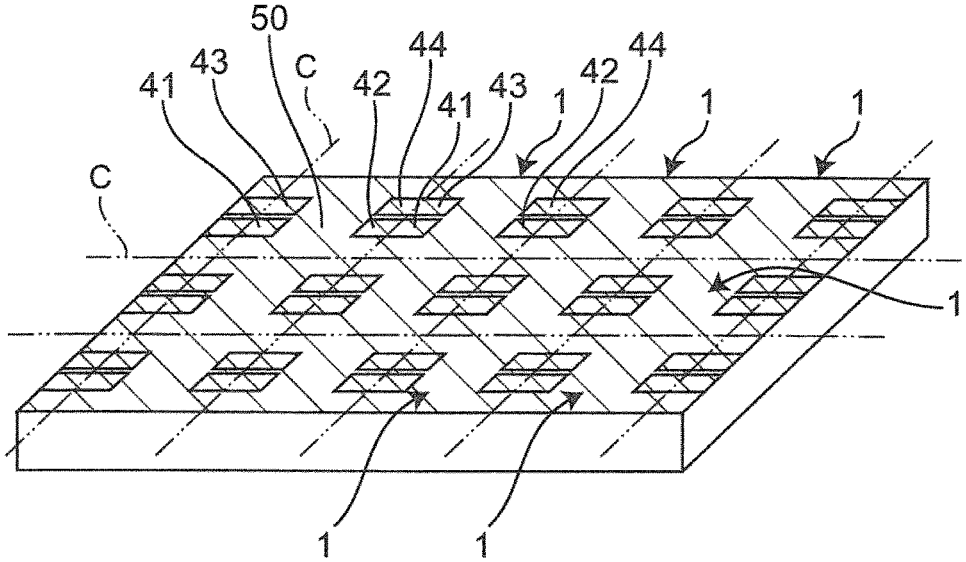
FIG. 3D is an explanatory view of the method for producing an inductor component.

As illustrated in FIG. 3C, multilayer metal films 410 represented by a hatch pattern are formed in the through-holes 50*a* to form a mother substrate 100. The multilayer metal films 410 constitute the external terminals 41 to 44 before cutting. As illustrated in FIG. 3D, the mother substrate 100, i.e., the sealed multiple substantially spiral lines 21 and 22, is cut along cut lines C with, for example, a dicing blade into pieces each including the two substantially spiral lines 21 and 22, thereby producing the multiple inductor components 1. The multilayer metal films 410 are cut along cut lines C to form the external terminals 41 to 44. A method for producing the external terminals 41 to 44 may be a method in which the multilayer metal films 410 are cut as described above or may be a method in which the insulating film 50 is removed in advance in such a manner that the through-holes 50*a* have the shape of the external terminals 41 to 44, and then the multilayer metal films 410 are formed.

Method for Producing Multilayer Metal Film 410

Figure 4A:
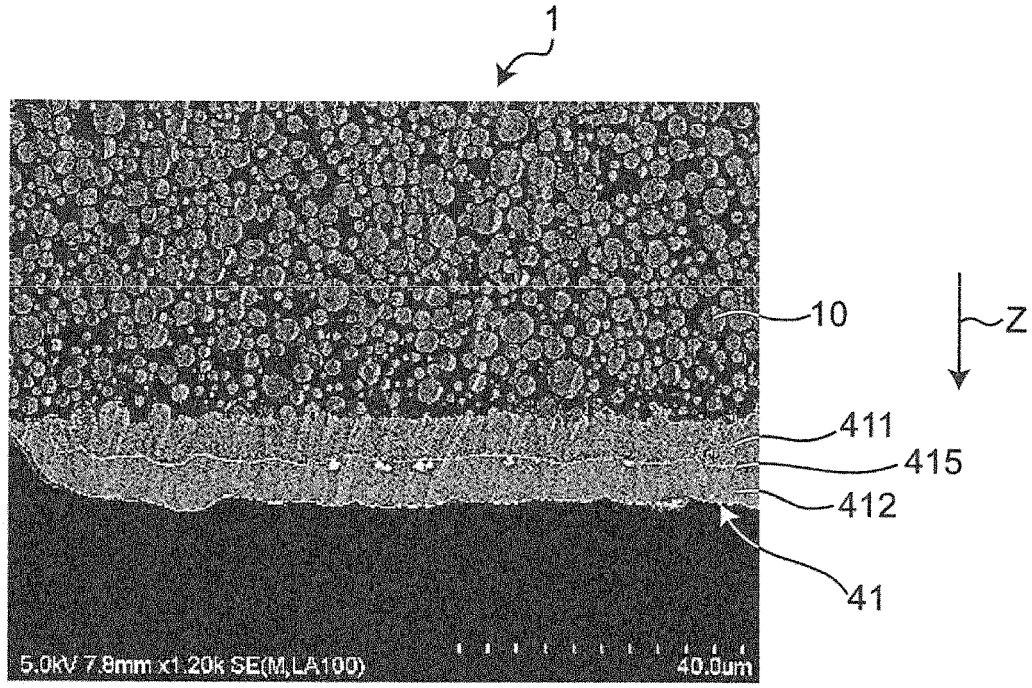
FIG. 4A illustrates an image of an inductor component according to a first embodiment with a scanning electron microscope.
Figure 4B:
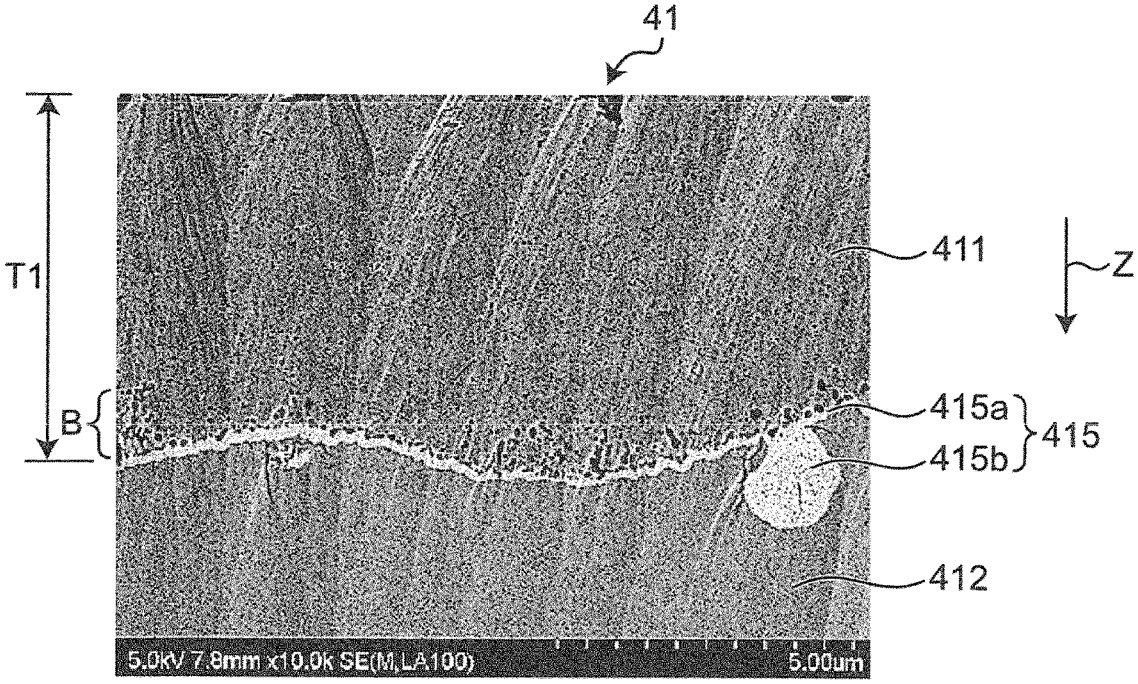
FIG. 4B illustrates an enlarged image of an external terminal.

A method for producing each of the multilayer metal films 410 will be described below. FIG. 4A is a cross-sectional SEM image of the first external terminal 41 (an example of each multilayer metal film 410) of the inductor component 1. FIG. 4B is an enlarged image of the catalytic layer 415 and its neighborhood in FIG. 4A. FIGS. 4A and 4B are images of cross sections obtained by cutting the first external terminal 41 at the center of the surface (a main surface of the first external terminal 41 exposed) perpendicular to the film thickness of the first external terminal 41, as described above. In FIGS. 4A and 4B, the top and bottom thereof are reverse to those of FIGS. 1B and 2, and a downward direction is the Z direction.

As described above, the end faces of the substantially columnar lines 31 to 34 and the base 10 are exposed at the through-holes 50*a* in a state in which the through-holes 50*a* are formed in the insulating film 50. The end faces of the substantially columnar lines 31 to 34 and the upper surface of the base 10 exposed at the through-holes 50*a* are subjected to, for example, electroless plating treatment to form Cu layers each serving as the first metal film 411 that is in contact with the base 10 and that is electrically conductive.

A Pd layer serving as the catalytic layer 415 for forming the second metal film 412 is formed on each first metal film 411. Specifically, the Pd layer is formed by, for example, substitution Pd catalyst treatment. In the substitution Pd catalyst treatment, the protruding portions 415*b* protruding toward the upper layer (second metal film 412) are formed on the catalytic layer 415 under specific treatment conditions. Specifically, for example, the substitution Pd catalyst treatment is performed at about 45° C. for about 10 minutes at a Pd concentration of about 0.02 g/L to form the protruding portions 415*b* as illustrated in FIGS. 4A and 4B. Regarding the range of the film thickness of the entire catalytic layer 415 including the protruding portions 415*b*, the minimum film thickness is about 2 nm, and the maximum film thickness is about 205 nm.

A Ni layer serving as the second metal film 412 having resistance to solder leaching is formed on each catalytic layer 415 including the protruding portions 415*b* by, for example, electroless plating treatment. Accordingly, the protruding portions 415*b* has a shape extending into the second metal film 412.

A Au layer serving as the third metal film 413 having wettability is formed on the second metal film 412 by, for example, electroless plating treatment. Thereby, the multilayer metal films 410 can be formed.

The production conditions are merely an example and are not limited as long as the protruding portions 415*b* are formed. For example, in the production method described above, because the catalytic layer 415 contains Pd as a metal that promotes the oxidation of a reducing agent in a Ni plating solution used to form the Ni layer serving as the second metal film 412, the deposition of the Ni layer can be promoted by electroless plating treatment using the Pd layer as a catalyst. The catalytic layer 415 is not limited to the catalyst used in the electroless plating treatment and may be a layer (catalyst) containing a metal that promotes the deposition of the second metal film when the second metal film 412 is formed by another known method.

The catalytic layer 415 contains Pd, which is nobler than the Cu layer serving as the first metal film 411, and thus can easily form the Pd layer by a substitution reaction with the Cu layer. The catalytic layer 415 may be formed on the Cu layer by another known method and may be composed of a metal less noble than the Cu layer.

Structure of Multilayer Metal Film 410

Figure 5:
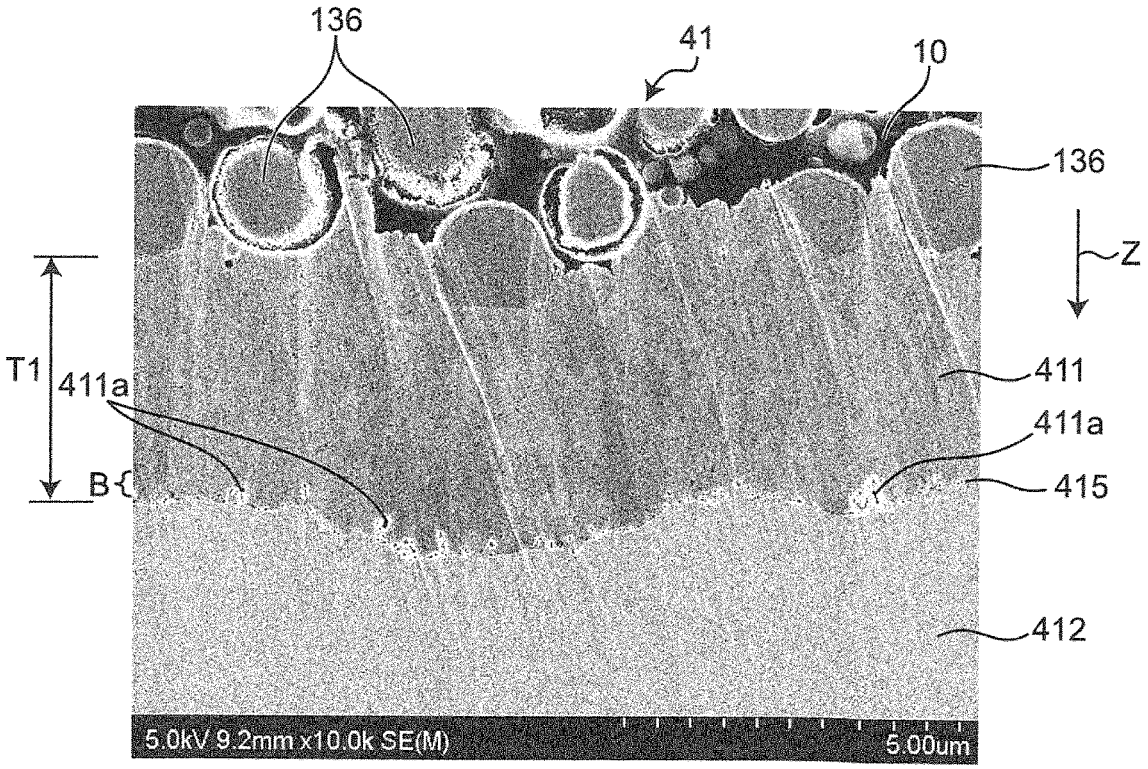
FIG. 5 illustrates an image of an inductor component according to a second embodiment with a scanning electron microscope.

The structure of each of the multilayer metal films 410 will be further described. FIG. 5 is a cross-sectional SEM image of the first external terminal 41 (an example of the multilayer metal films 410) of the inductor component 1. As described above, FIG. 5 is an image of a cross section obtained by cutting the first external terminal 41 along a plane passing through the center of a surface (a main surface of the first external terminal 41 exposed) perpendicular to the film thickness of the first external terminal 41. As with FIGS. 4A and 4B, a downward direction in FIG. 5 is the Z direction.

As illustrated in FIG. 5, in each multilayer metal films 410, the first metal film 411 includes the pore portions 411*a* adjacent to the catalytic layer 415. The pore portions 411*a* of the first metal film 411 have a size of about 0.5 μm or less. The multiple pore portions 411*a* are present. The maximum number of the pore portions 411*a* communicating with each other is about 10 or less and, in FIG. 5, about five. The first metal film 411 and the second metal film 412 are electrically coupled to each other. The electrical resistance between the first metal film 411 and the second metal film 412 is about 1 mΩ or less. In this case, it can be determined that the first metal film 411 and the second metal film 412 are electrically coupled to each other without any problem and no delamination occurs between the first metal film 411 and the second metal film 412. As described above, the pore portions 411*a* of the first metal film 411 adjacent to the catalytic layer 415 can reduce internal stress accumulated in the multilayer metal film 410.

For example, when the catalytic layer 415 composed of Pd is formed on the first metal film 411 composed of Cu, the pore portions 411*a* can be formed on a portion of the first metal film 411 adjacent to the catalytic layer 415 under specific treatment conditions in treatment for substitution of Pd for Cu. Specifically, it has been confirmed that, for example, the pore portions 411*a* as illustrated in FIG. 5 are formed with a treatment liquid, used for the substitution treatment, having a Pd concentration of about 3 g/L and a temperature of about 25° C. or higher.

The production conditions are merely an example and are not limited as long as the pore portions 411*a* are formed.

The protruding portions 415*b* and the pore portions 411*a* can be independently formed. However, by adjusting the concentration of the treatment liquid, the treatment temperature, and the treatment time, the protruding portions 415*b* and the pore portions 411*a* can be simultaneously formed, and only the protruding portions 415*b* and only the pore portions 411*a* can be separately formed.

The present disclosure is not limited to the foregoing embodiment, and can be changed in design without departing from the gist of the present disclosure.

In the foregoing embodiment, two of the first inductor device and the second inductor device are arranged in the base. However, three or more inductor devices may be arranged. In this case, six or more external terminals and six substantially columnar lines are arranged.

In the foregoing embodiment, the number of turns of the substantially spiral line of each inductor device is less than about one. However, the substantially spiral line may be a curved line in which the number of turns of the substantially spiral line is more than about one. The number of layers of the substantially spiral lines in the inductor device is not limited to one, and a multilayer structure including two or more layers may be used. The arrangement of the first substantially spiral line of the first inductor device and the second substantially spiral line of the second inductor device is not limited to the configuration in which the first and second substantially spiral lines are arranged on the same plane parallel to the first main surface and may be a configuration in which the first and second substantially spiral lines are arranged in a direction perpendicular to the first main surface.

In the foregoing embodiment, each external terminal is disposed on a surface of the base. However, at least part of the external terminal may be buried in the base. For example, the first metal film of the external terminal may be buried in the base, and the second metal film or the third metal film of the external terminal may be exposed at a surface of the base.

In the foregoing embodiment, although the multilayer metal film is used as the external terminal of the inductor component, the multilayer metal film is not limited thereto. For example, the multilayer metal film may be used as an internal electrode of the inductor component. Additionally, the use of the multilayer metal film is not limited to the inductor component. The multilayer metal film may be used for other electronic components such as capacitor components and resistor components and may be used for circuit boards incorporating these electronic components. For example, the multilayer metal film may be used as a line pattern of a circuit board.

In the embodiment, the first metal film includes the pore portions adjacent to the catalytic layer. However, the first metal film may be free from a pore portion.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer metal film disposed on a base having insulating properties, comprising:

a first metal film in contact with the base, the first metal film being electrically conductive;

a second metal film covering the first metal film from a side of the first metal film opposite to the base, the second metal film having resistance to solder leaching; and a catalytic layer disposed between the first metal film and the second metal film, the catalytic layer having a base portion and a protruding portion that extends from the base portion, the protruding portion protruding toward and extending into the second metal film.

2. The multilayer metal film according to claim 1, wherein a height of the protruding portion of the catalytic layer is about two or more times a film thickness of a portion of the catalytic layer other than the protruding portion.

3. The multilayer metal film according to claim 1, wherein a portion of the catalytic layer other than the protruding portion has a film thickness of from about 10 nm to about 30 nm.

4. The multilayer metal film according to claim 1, wherein a height of the protruding portion of the catalytic layer is about ½ or less of a film thickness of the second metal film.

5. The multilayer metal film according to claim 1, wherein the catalytic layer contains a metal nobler than the first metal film.

6. The multilayer metal film according to claim 1, wherein the base includes a magnetic resin layer containing a resin and a magnetic metal powder contained in the resin, and the first metal film is in contact with the magnetic resin layer.

7. The multilayer metal film according to claim 1, further comprising:

a third metal film on the second metal film, the third metal film having wettability.

8. The multilayer metal film according to claim 1, wherein the first metal film contains Cu.

9. The multilayer metal film according to claim 1, wherein the second metal film contains Ni.

10. The multilayer metal film according to claim 1, wherein the catalytic layer contains Pd.

11. An inductor component, comprising:

a base;

multilayer metal film according to claim 1; and an inductor device disposed in the base, the multilayer metal film serving as an external terminal exposed at the base, the external terminal being electrically coupled to the inductor device.

12. The multilayer metal film according to claim 2, wherein a portion of the catalytic layer other than the protruding portion has a film thickness of from about 10 nm to about 30 nm.

13. The multilayer metal film according to claim 2, wherein a height of the protruding portion of the catalytic layer is about ½ or less of a film thickness of the second metal film.

14. The multilayer metal film according to claim 2, wherein the catalytic layer contains a metal nobler than the first metal film.

15. The multilayer metal film according to claim 2, wherein the base includes a magnetic resin layer containing a resin and a magnetic metal powder contained in the resin, and the first metal film is in contact with the magnetic resin layer.

16. The multilayer metal film according to claim 2, further comprising:

a third metal film on the second metal film, the third metal film having wettability.

17. The multilayer metal film according to claim 2, wherein the first metal film contains Cu.

18. The multilayer metal film according to claim 2, wherein the second metal film contains Ni.

19. The multilayer metal film according to claim 2, wherein the catalytic layer contains Pd.

20. An inductor component, comprising:

a base;

multilayer metal film according to claim 2; and an inductor device disposed in the base, the multilayer metal film serving as an external terminal exposed at the base, the external terminal being electrically coupled to the inductor device.

* * * * *